United States Patent [19]

Manning

[11] Patent Number: 4,632,664

[45] Date of Patent: Dec. 30, 1986

[54] TOPPLING GAME APPARATUS

[76] Inventor: Eugene P. Manning, P.O. Box 471, Gresham, Oreg. 97030

[21] Appl. No.: 737,812

[22] Filed: May 23, 1985

[51] Int. Cl.[4] ..... A63H 33/04

[52] U.S. Cl. ..... 446/2

[58] Field of Search ..... 446/2, 487; 273/1 R

[56] References Cited

U.S. PATENT DOCUMENTS

| | | |
|---|---|---|
| 2,289,690 | 7/1942 | Bakalyar . |
| 2,402,390 | 6/1946 | Gardner . |
| 3,621,601 | 1/1969 | Greenberg et al. . |
| 3,999,761 | 12/1976 | Daniels . |
| 4,138,797 | 2/1979 | Stolar . |

FOREIGN PATENT DOCUMENTS

| | | |
|---|---|---|
| 548858 | 4/1932 | Fed. Rep. of Germany . |
| 2218689 | 12/1972 | Fed. Rep. of Germany . |

*Primary Examiner*—F. Barry Shay

*Attorney, Agent, or Firm*—Klarquist, Sparkman, Campbell, Leigh & Whinston

[57] ABSTRACT

A toppling game apparatus having a plurality of connectable toppling units is disclosed. The toppling units each contain a toppling member attached to a base member in a manner permitting pivotal rotation of the toppling member. The axis of pivotal rotation is spaced laterally from the toppling member. Each toppling member also has a system to control the weight distribution of the toppling member. The system consists of a weight member fixed at a desired position within the toppling member, or a movable weight member slidably adjustable along the toppling member. By controlling weight distribution, in combination with the laterally spaced pivotal rotation system, the toppling rate of the toppling member can be increased, decreased or stopped when desired. The toppling units are connectable to each other to form the game apparatus. In operation, each of the toppling members is placed in a vertical position. When one of the toppling members is toppled, it will strike an adjacent member causing it to fall in a similar manner, thereby creating a toppling chain reaction.

13 Claims, 8 Drawing Figures

TOPPLING GAME APPARATUS

BACKGROUND OF THE INVENTION

The present invention relates to a toppling game apparatus, and more particularly to a toppling game apparatus having a plurality of weighted toppling members which cooperate to produce a toppling chain reaction. Each toppling member has a selectively positionable weight member, or a fixed weight member positioned at various locations within the toppling member. The weight member, in either form, enables the toppling rate of the toppling members to be adjusted.

The toppling of dominoes arranged in a straight or curved line is a popular activity. The effects produced by long and elaborate chains of toppling dominoes are entertaining and visually pleasing. However, it is difficult and time-consuming to set up these arrangements. Each domino must be carefully positioned in the chain. Otherwise, successive toppling of the dominoes will not occur. Also, the accidental toppling of one domino during preparation of the domino arrangement can cause an undesired and untimely chain reaction. To overcome these problems, numerous toppling games have been created to provide the desirable effects described above, while avoiding the difficulties associated therewith.

For example, U.S. Pat. No. 2,402,390 to Gardiner describes a toy having a plurality of hinged toppling blocks. In one form of the invention, a miniature clown figurine is pushed over causing the successive toppling of the toppling blocks. As the last block is toppled, a toy horse and rider are pushed into a simulated tank of water.

U.S. Pat. Nos. 2,289,690 to Bakalyar and 3,621,601 to Greenberg, et al. show toppling games in which a plurality of toppling members are attached to a base unit. In the U.S. Pat. No. 2,289,690, toppling blocks are attached to a base member using flexible elements, namely rubber bands. When one block is toppled, the remaining blocks on the base are successively toppled. The U.S. Pat. No. 3,621,601 describes a toppling game in which toppling plates or "chips" are pivotally attached to a base unit using a snap lock pivot connector having a counterweight. The individual base units are connectable in straight or curved arrangements.

Another toppling game is shown in U.S. Pat. No. 4,138,797 to Stolar. In this patent, a series of domino toppling members are hingedly attached to base blocks connected by a pull cord to form a game apparatus.

German Pat. No. 2,218,689 discloses a toppling game having channel-shaped base units and a series of rectangular toppling elements hingedly fastened to each base unit. The base units may be curved or straight and are connectible to form a multi-base arrangement. German Pat. No. 548,858 shows a toppling game having a plurality of toppling blocks pivotally mounted on a base. Attached to each block is a small flag-like tongue element. When one block is toppled, the remaining blocks topple in succession. As each block topples, the tongue element moves from a horizontal position to a vertical position. The blocks are reset by passing one's hand along the vertically oriented tongues.

The present invention represents an improvement on the above-described game units. In each of the above games, it is not possible to control the rate of toppling, otherwise known as "cadence". This is also a problem with respect to arrangements of dominoes. Toppling occurs at a high rate of speed, making it difficult to fully appreciate the resulting visual effects. Also, the time required for all of the members to topple is relatively short in comparison to the time necessary for setting up the toppling members. Furthermore, in many toppling games, the toppling members are quite unstable. Great care must be taken to avoid premature toppling when the toppling members are being set up. The present invention avoids these problems by using toppling members having a weight distribution control system. In addition, each toppling member is attached to a base member in a manner permitting the pivotal rotation of the toppling member with respect to the base member. The axis of pivotal rotation with respect to the base member is spaced laterally from the toppling member. By controlling weight distribution, in combination with the laterally spaced pivotal rotation system, the toppling rate of the toppling members can be increased, decreased, or stopped when desired.

SUMMARY OF THE INVENTION

An object of the present invention is to provide a new and improved toppling game apparatus.

Another object of the present invention is to provide a toppling game apparatus which is easy to use.

An additional object of the present invention is to provide a toppling game apparatus in which the toppling rate is adjustable.

Still another object of the present invention is to provide a toppling game apparatus in which the probability of premature toppling is minimized.

A still further object of the present invention is to provide a toppling game apparatus which requires minimal time for resetting the toppling units after toppling has been accomplished.

Other objects and advantages of the invention will become apparent from a consideration of the following detailed description and drawings.

BRIEF DESCRIPTION OF DRAWINGS

The invention will best be understood by reference to the following drawings wherein.

DETAILED DESCRIPTION OF PREFERRED EMBODIMENTS

Figure 1:
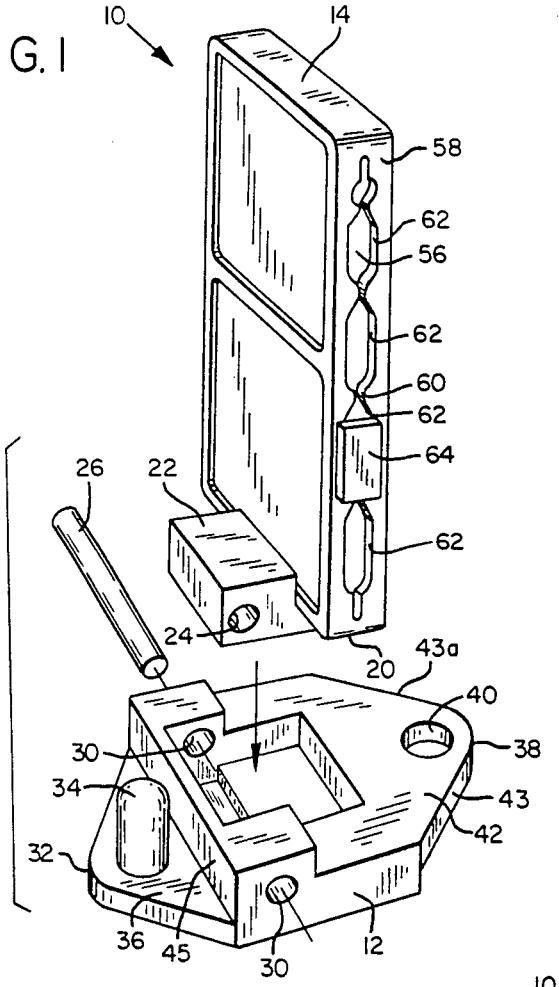
FIG. 1 is an exploded perspective view showing a toppling unit of the present invention having a selectively movable weight member therein.

The present invention consists of a plurality of toppling units releasably connected to form a toppling game apparatus. In FIG. 1, a toppling unit 10 having a base member 12 and toppling member 14 is shown. The toppling member 14 is a hollow, planar structure, preferably rectangular in shape. It is pivotally mounted on the base member 12.

The exterior of the toppling member 14 is proportioned to resemble a domino as shown in FIG. 1. At lower end 20, the toppling member 14 is attached to a hinge connector 22. The hinge connector 22 may be molded onto end 20 of the toppling member 14 to form an integral unit. In the alternative, the hinge connector 22 can be affixed to the end 20 of the toppling member 14 using adhesive materials or the like. The hinge connector 22 contains a bore 24 through which a metal hinge pin 26 is inserted after placement of the toppling member 14 and hinge connector 22 onto the base member 12. In the alternative, the hinge pin may be made of plastic and formed integrally with the hinge connector 22.

Figure 7:
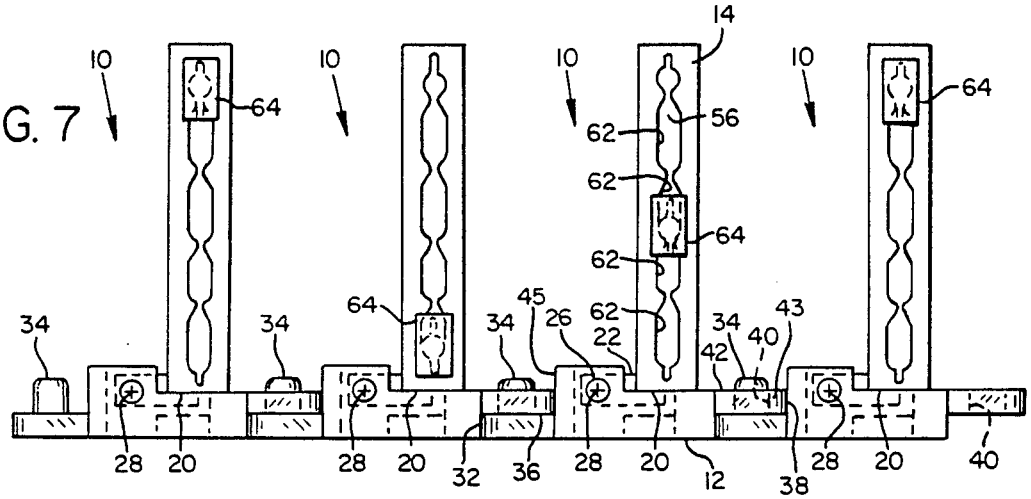
FIG. 7 is a side elevation view of a series of connected toppling units with adjustable weights in different positions having their respective toppling members in an upright position.
Figure 8:
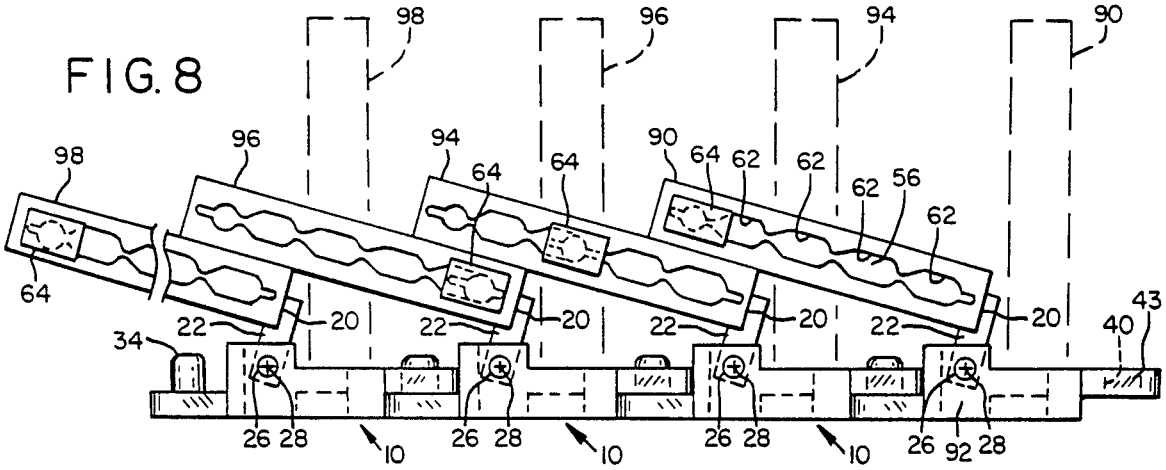
FIG. 8 is a side elevation view of the series of connected toppling units of FIG. 7 with the toppling members in a down position.

Attachment of the toppling member 14 in the above-described manner permits the pivotal rotation of the toppling member 14 with respect to the base member 12. As shown in FIGS. 7 and 8, the axis of pivotal rotation 28 about each hinge pin 26 is spaced laterally from its respective toppling member. This arrangement is an important characteristic of the present invention. It provides for increased toppling member stability. Increased stability minimizes the possibility of premature toppling. This design, in combination with the weight distribution control means described below, also allows the toppling rate or "cadence" to be controlled.

Figure 6:
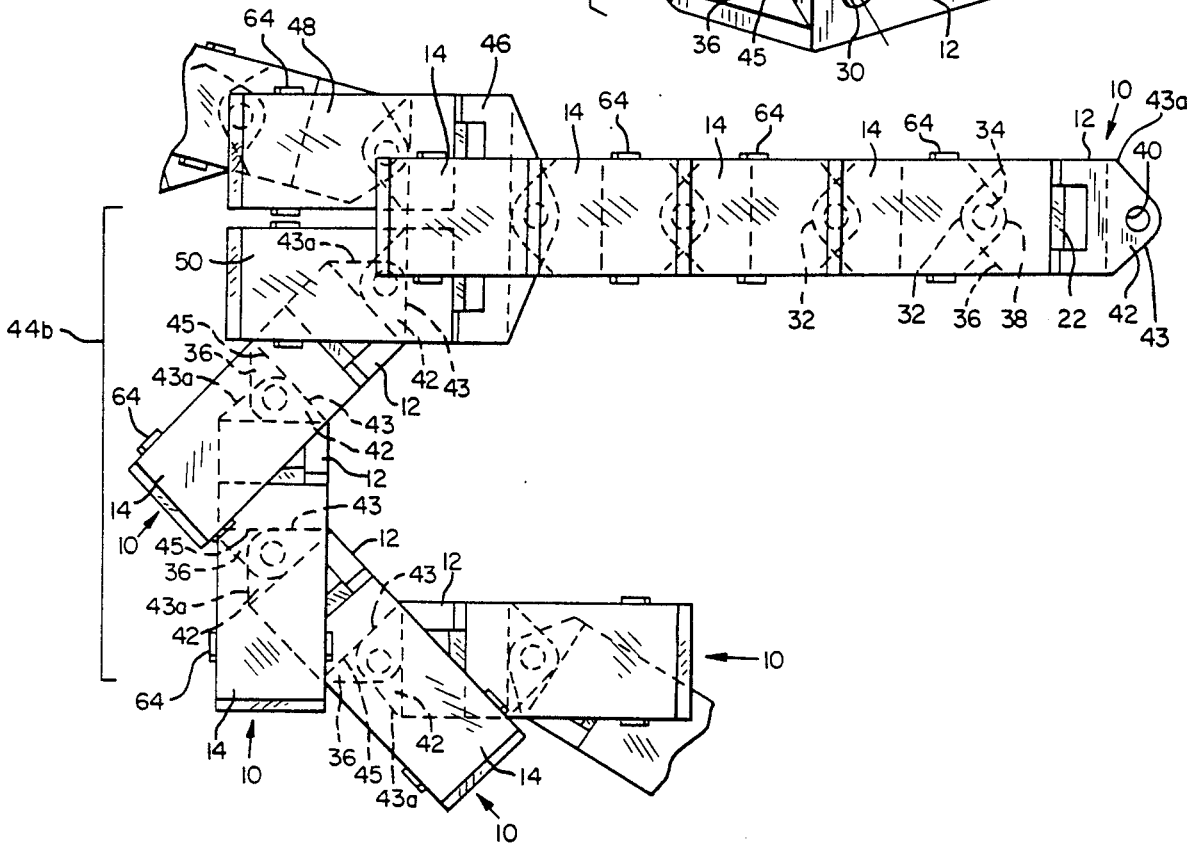
FIG. 6 is a top plan view of the series of connected toppling units of FIG. 5 with the toppling members in a down position.

As shown in FIG. 1, the base member 12 has two aligned bores 30 for receipt of the hinge pin 26. At one end 32 of the base member 12 is a male connector member 34 extending upward from a triangular section 36. At end 38 is a complementary female aperture 40 in a triangular section 42. This male/female coupling system permits the releasable connection of numerous toppling units to each other, as shown in FIGS. 5–8. In addition, this system permits pivotal movement of successively arranged toppling units with respect to each other. Such pivotal movement allows the formation of sharply curved sections of connected toppling units. A sharply curved section of successively arranged toppling units 10 is shown at **44*a* in FIG. 5. However, the pivotal movement between the successive toppling units 10 is limited by the engagement of sides 43 or 43*a* on one base member with abutment 45 on the next base member. The amount of pivotal movement is limited so that, after toppling, the fallen toppling members 14 will lie in an overlapping relationship with respect to each other. This overlapping relationship, shown at 44*b* in FIG. 6, is necessary to facilitate fast and easy resetting of the toppling members 14** to an upright position.

The base members 12 of the toppling units 10 may, if desired, be formed in various configurations. For example, as in FIG. 5, a dual base member 46 having two toppling members 48, 50 is shown. The dual base member 46 has two male connector members 52 and one female aperture 54. The dual base member 46 allows branched chains of toppling units to be formed. Other base members incorporating the salient characteristics of the present invention may be used, including those with four branches, and those having elevating structures to form a bridge-like unit (not shown). Furthermore, other releasable connecting systems capable of complementary engagement may be used. These connecting systems must have the capacity for pivotal movement as described above, and may include snap connector systems or the like.

Figure 3:
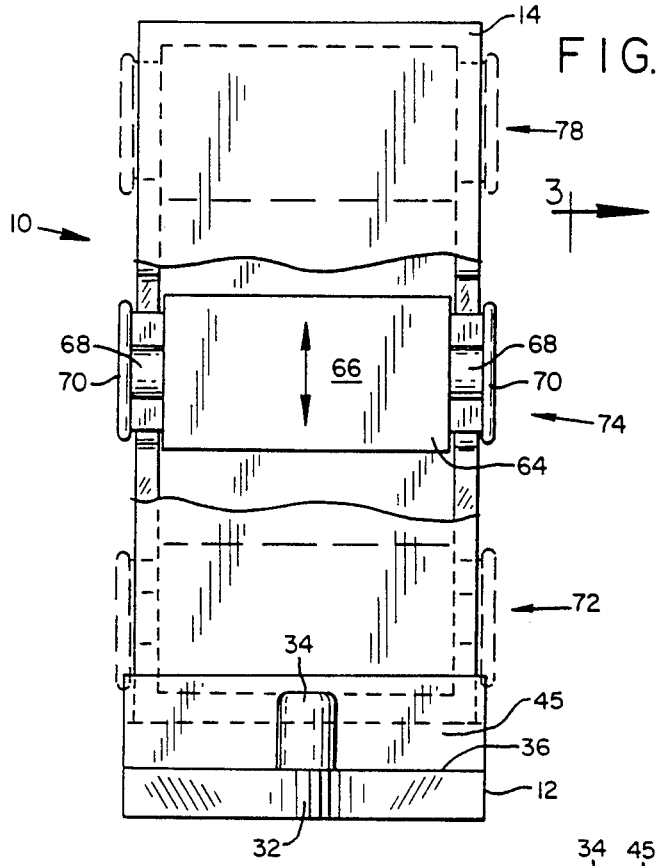
FIG. 3 is a front elevation view taken along lines 3—3 of FIG. 2 with parts broken away for clarity.
Figure 2:
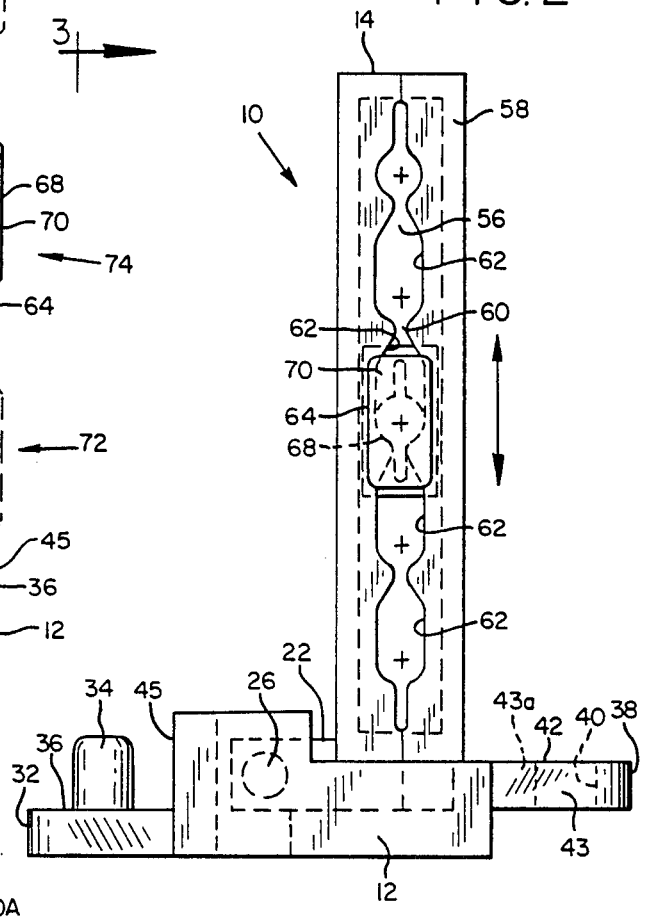
FIG. 2 is a side elevation view of the toppling unit of FIG. 1.

Each toppling member 14 further incorporates weight means for controlling the toppling rate or "cadence". In the embodiment of FIG. 1, the toppling member 14 has a hollow cavity 56, and sides 58. Each side has a slot 60 with a plurality of vertically spaced notched openings 62. Positioned as shown in FIGS. 1, 2, and 3 is a selectively positionable weight member 64 made of steel, zinc or other heavy material. The weight member 64 is designed to alter the center of gravity and weight distribution of the toppling member 14. As indicated in FIG. 3, the weight member 64 comprises a substantially rectangular center portion 66, outwardly-extending positioning cams 68, and handle portions 70. The weight member 64 is movable along the longitudinal axis of the toppling member 14, shown in FIG. 2. To position the weight member 64 at a selected location within the hollow cavity 56, the weight member 64 is grasped by the handle extensions 70 and moved upward or downward as desired. The weight member 64 is retained in position by the placement of positioning cams 68 in one of the notched openings 62. The notched openings 62 have widths slightly less than the diameter of the cams 68. The sides 58 of the toppling member 14 are made of a suitable resilient plastic material. The resilient plastic enables the sides 58 to flex outward when the cams 68 are positioned within the openings 62. The number of notched openings 62 in the present invention may be varied as desired.

Referring to FIG. 3, with the weight member 64 in a downward position 72, the toppling cadence will be slowed substantially. Cadence is reduced because the center of gravity of the toppling member 14 is closer to the hinge pin 26. Should a plurality of toppling members 14 having a weight member 64 in this position be placed in sequence, the overall toppling rate of the toppling chain will slow to a halt. With the weight member 64 at an intermediate position 74, the toppling rate will proceed at a moderate, self-perpetuating rate. With the weight member 64 in position 78, the toppling rate will be further increased.

By arranging strings of toppling units 10 having toppling members 14 with weights 64 in different positions, the toppling rate can be made to successively speed up and slow down as desired. Such a string of toppling units 10 is shown in FIG. 7. This variation in speed creates a unique effect which cannot be obtained with ordinary dominoes or other members lacking the weight system and laterally spaced pivot arrangement described above.

Figure 4:
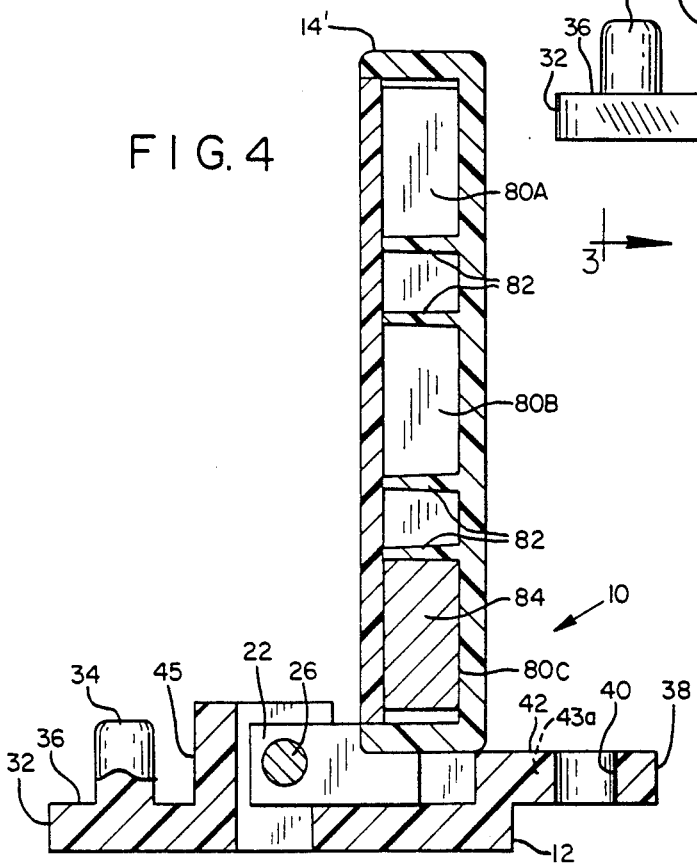
FIG. 4 is a vertical section view showing another embodiment of a toppling unit having a fixedly positioned weight member therein.
Figure 5:
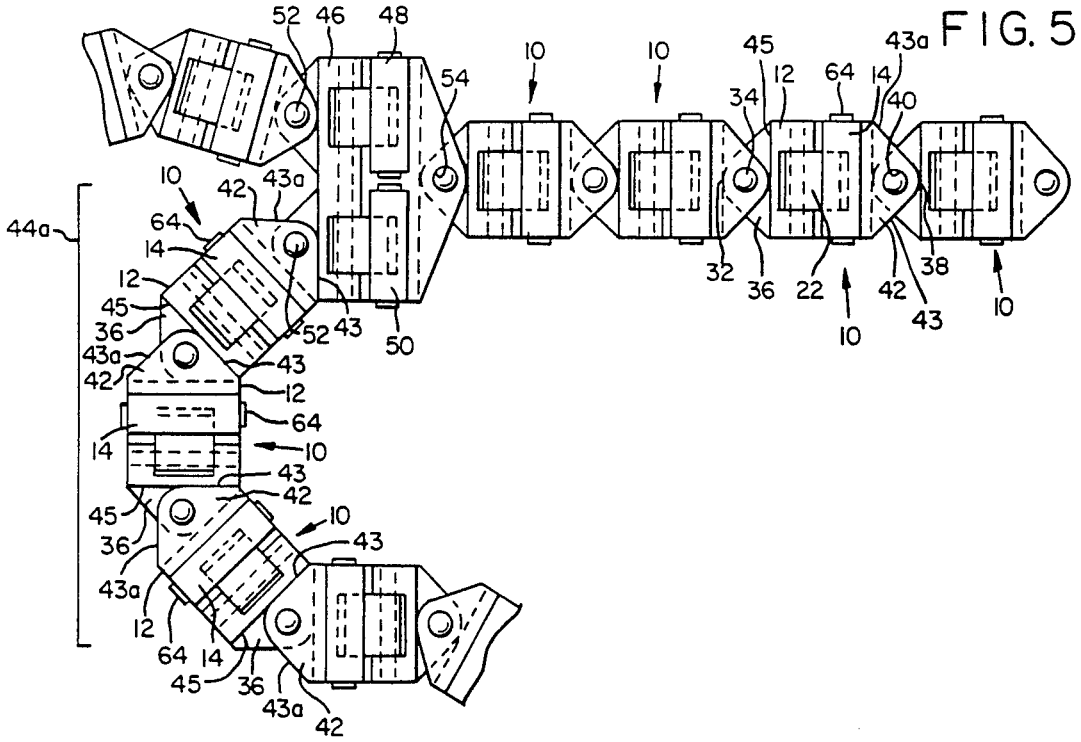
FIG. 5 is a top plan view of a series of connected toppling units having their respective toppling members in an upright position.

Another embodiment of the present invention is shown in FIG. 4. This embodiment has the same base member 12, hinge pin 26, and hinge connector 22 as shown in FIG. 1. However, the embodiment of FIG. 4 has a different weight distribution control system. Specifically, the toppling member 14' of FIG. 4 has a plurality of interior cavities **80*a*, 80*b*, and 80*c* separated by partition members 82. Within the toppling member 14', a weight member 84 is provided. The weight member 84 is positioned in one of the cavities 80*a*, 80*b*, and 80*c*. It is contemplated that the number of cavities in toppling member 14'** is not limited to three, and may include more or less as desired.

To identify the position of the weight member 84 in the toppling member 14', suitable external identification markings are used. These markings would include various colors or symbols applied to the exterior of the toppling member 14'. By arranging strings of toppling units 10 with toppling members 14' having a weight member 84 in different positions, modifications of toppling cadence, as described above, can be accomplished.

In operation, as shown in FIG. 8, the toppling units are arranged in sequence. A desired toppling cadence is selected using the weight systems described above. The toppling member 90 of the first toppling unit 92 in the sequence is urged forward, causing it to fall and strike the next toppling member 94. A toppling chain reaction is created, and the remaining toppling members 96, 98 in the sequence are toppled, creating unique visual effects. As shown in FIG. 8, the toppling members, after toppling, lie in an overlapping relationship with respect to each other. This relationship exists even when sharp curves are present in the sequence. Because the toppled toppling members overlap, resetting the toppling members to an upright position is fast and requires little effort.

Having described herein various embodiments of the present invention, it is not intended that the invention be limited to the specific forms described above. Thus, the present invention shall not be limited or restricted to specific details set forth herein, and the invention shall be considered as that falling within the scope of the following claims.

I claim:

1. A toppling game apparatus comprising:

a plurality of base members;

coupling means for connecting said base members together;

a plurality of toppling members, at least one of said toppling members being pivotally attached to each of said base members, said toppling members each comprising a substantially planar structure having a hollow interior; and weight means associated with said toppling members to control the weight distribution and toppling rate of said toppling members, said weight means comprising a weight member and wherein each toppling member includes means for mounting said weight member in a selected one of a plurality of positions within said hollow interior.

2. The toppling game apparatus of claim 1 wherein each toppling member is pivotally attached to a base member at a position on said base member spaced laterally from said toppling member.

3. The toppling game apparatus of claim 1 wherein said coupling means includes releasable coupling means for releasably connecting said base members together in co-planar relationship, said coupling means allowing pivotal movement of said base members with respect to each other while remaining in said co-planar relationship.

4. The toppling game apparatus of claim 3 wherein said base members further comprise stop means for limiting the amount of said pivotal movement so that all adjacent ones of said toppling members, after toppling, will be in an overlapping relationship with respect to each other.

5. The toppling game apparatus of claim 1 wherein said toppling members each comprises a substantially planar structure having parallel side walls, each wall having an elongate slot therethrough.

6. The toppling game apparatus of claim 5 wherein said means for mounting said weight member in a selected one of a plurality of positions comprises a plurality of notched openings in each of said elongate slots for engagement of said weight member.

7. The toppling game apparatus of claim 1 wherein said means for mounting said weight member in a selected one of a plurality of positions comprises a plurality of partition members within said hollow interior of each toppling member, said partition members being adapted to retain said weight member in a selected position within each toppling member.

8. A toppling game apparatus comprising:

a plurality of base members;

a plurality of toppling members;

hinge means for pivotally attached each toppling member to a base member in a position on said base member spaced laterally from said toppling member;

releasable coupling means for releasably connecting said base members together in co-planar relationship, said coupling means allowing pivotal movement of said base members with respect to each other while remaining in said co-planar relationship; and stop means for limiting the amount of said pivotal movement so that all adjacent ones of said toppling members, after toppling, will be in an overlapping relationship with respect to each other.

9. The toppling game apparatus of claim 8 wherein said stop means comprises a vertical abutment on one end of each base member, and a triangular portion having two vertical faces on the other end of said base member, whereby engagement of one of said faces of one base member with said abutment on another base member limits said pivotal movement of said base members with respect to each other.

10. The toppling game apparatus of claim 8 wherein said coupling means comprises a male connector member at one end of each base member, and a complementary female aperture at the other end of said base member.

11. The toppling game apparatus of claim 8 wherein said toppling members each comprise weight means to control the weight distribution and toppling rate of said toppling members.

12. A toppling game apparatus comprising:

a plurality of base members;

coupling means for connecting said base members together;

a plurality of toppling members, at least one of said toppling members being pivotally attached to each of said base members; and weight means associated with said toppling members to control the weight distribution and toppling rate of said toppling members, said weight means comprising a weight member and wherein each toppling member includes means for mounting said weight member in a selected one of a plurality of positions.

13. The toppling game apparatus of claim 12 wherein each toppling member attached to a base member is pivotally attached at a position on said base member spaced laterally from said toppling member.

* * * * *